United States Patent [19]

Dinulescu

[11] Patent Number: 4,596,285

[45] Date of Patent: Jun. 24, 1986

[54] HEAT EXCHANGER WITH RESILIENT CORNER SEALS

[75] Inventor: Horia A. Dinulescu, Edina, Minn.

[73] Assignee: North Atlantic Technologies, Inc., Bloomington, Minn.

[21] Appl. No.: 717,033

[22] Filed: Mar. 28, 1985

[51] Int. Cl.[4] ..... F28D 9/02

[52] U.S. Cl. ..... 165/82; 165/69; 165/166

[58] Field of Search ..... 165/166, 69, 81, 82, 165/83

[56] References Cited

U.S. PATENT DOCUMENTS

| | | | |
|---|---|---|---|
| 3,775,972 | 12/1973 | Perpall | 165/166 X |
| 4,442,886 | 4/1984 | Dinulescu | 165/166 X |
| 4,512,392 | 4/1985 | van Ee et al. | 165/166 X |

FOREIGN PATENT DOCUMENTS

| | | | |
|---|---|---|---|
| 137076 | 4/1934 | Austria | 165/166 |
| 117565 | 9/1984 | European Pat. Off. | 165/166 |
| 72228 | 8/1907 | Fed. Rep. of Germany | 165/166 |
| 114554 | 10/1978 | Japan | 165/166 |
| 946804 | 1/1964 | United Kingdom | 165/166 |

*Primary Examiner*—Sheldon J. Richter

*Attorney, Agent, or Firm*—James R. Haller; Gregory P. Kaihoi

[57] ABSTRACT

A cross flow heat exchanger for heat exchange between two fluids. The heat exchanger is of the type having a stack of spaced, parallel rectangular plates; a frame enclosing the plates and having generally rectangular end walls parallel to the plates and corner posts extending between corners of the end walls; and corner supports extending between the end walls and sealingly engaging respective aligned plate corners. The heat exchanger is characterized by including a plurality of leaf springs, each having a plurality of nested but individually resilient leaves elongated parallel to the corner posts and having a generally arcuate transverse cross-section providing spaced surfaces bearing respectively against a corner post and a corner support to resiliently seal the corner post to the corner support. The leaf springs therefore substantially prevent fluid flow between the corner post and the corner support, and further resiliently accommodate growth of the plates due to thermal expansion parallel to their planes.

13 Claims, 10 Drawing Figures

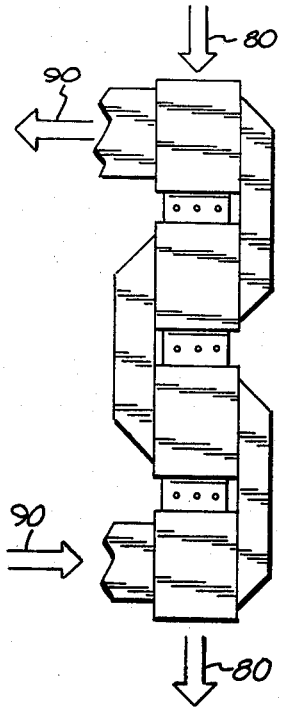
Fig. 1
Fig. 3
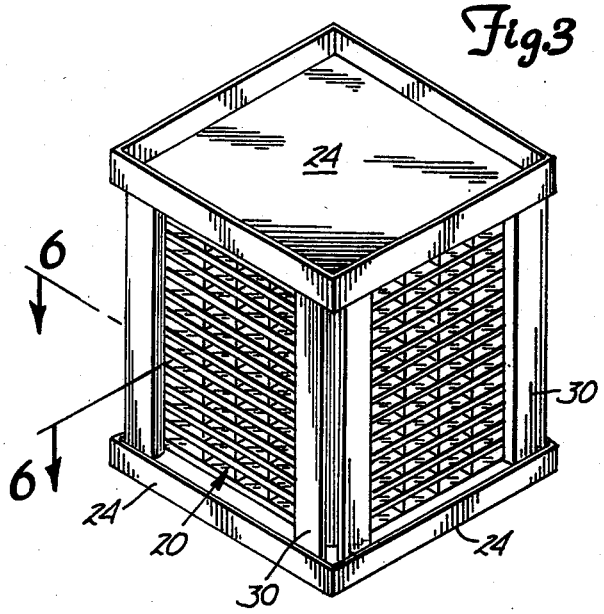
Fig. 2
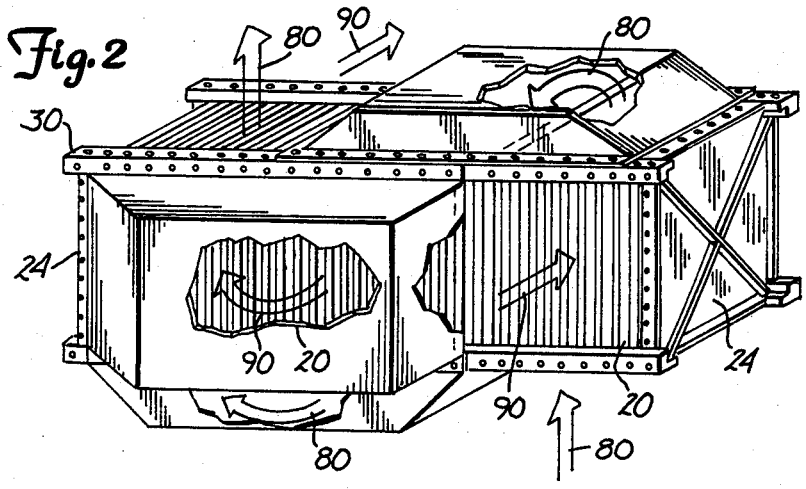

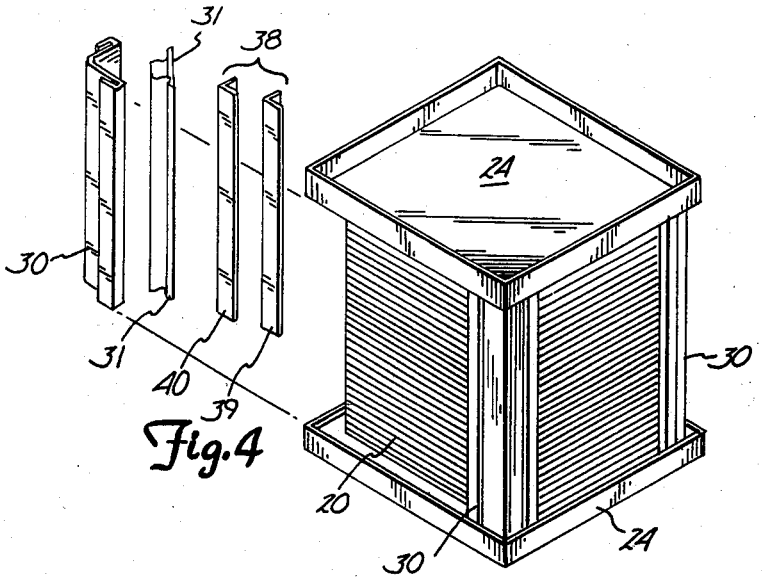
Fig.4
Fig.5
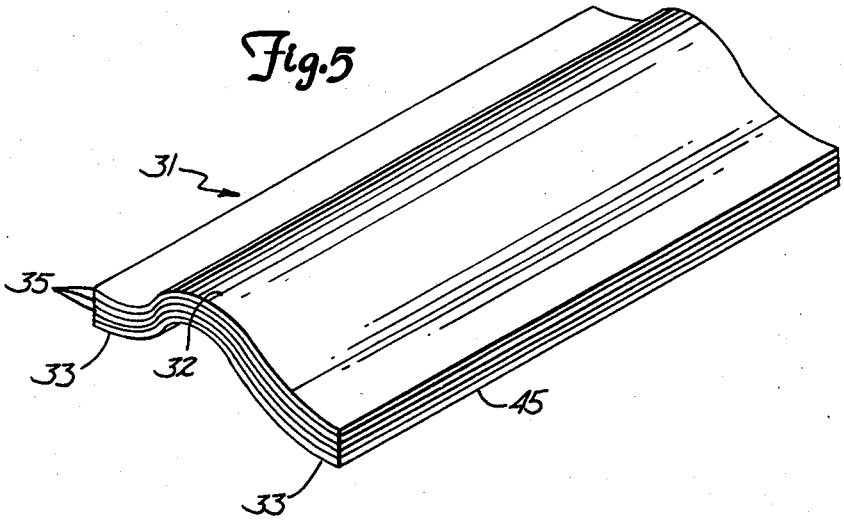

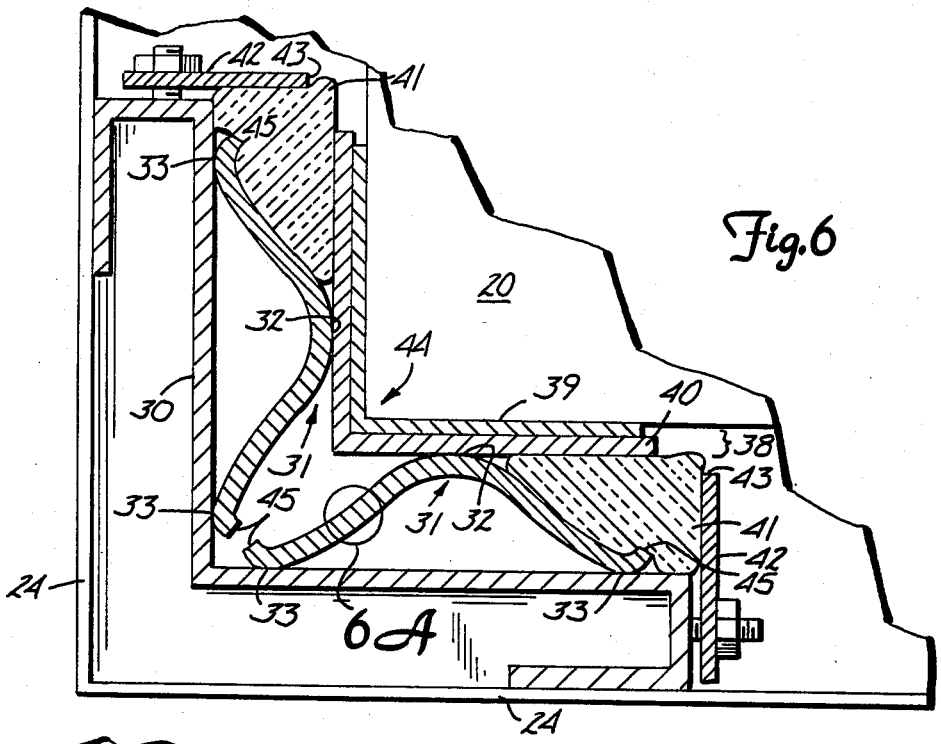
Fig.6
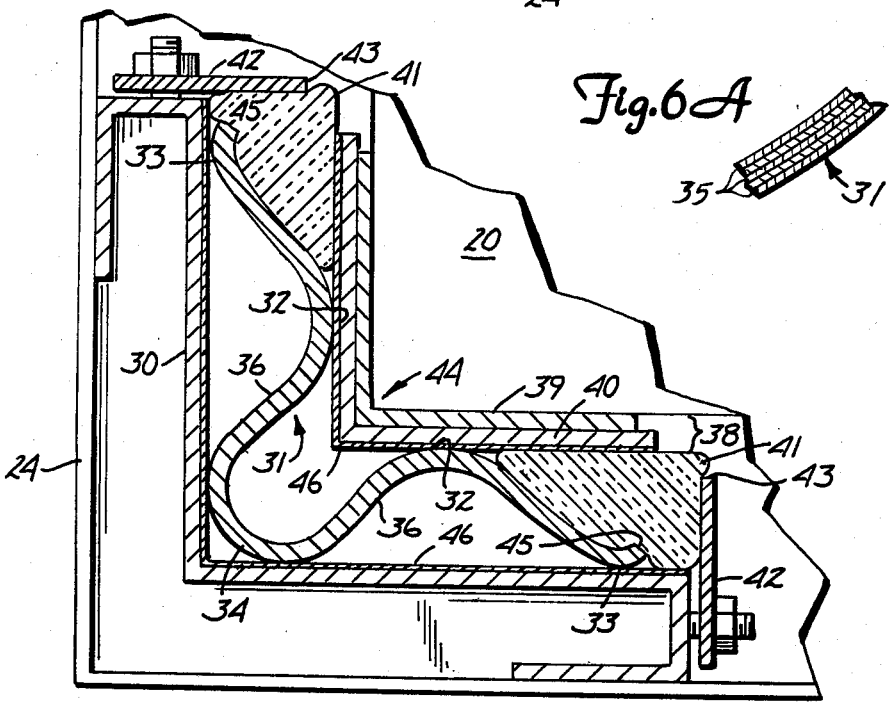
Fig.6A
Fig.8

HEAT EXCHANGER WITH RESILIENT CORNER SEALS

TECHNICAL FIELD

The invention relates to plate-type heat exchangers for use in heat recovery systems.

BACKGROUND ART

Heat exchangers are commonly used in heat recovery systems to conserve energy. Heat exchangers may be employed as air pre-heaters, for example, for furnaces, boilers and the like. In such systems, heat energy commonly is to be transferred from a hot flue gas to a stream of fresh combustion air. Extreme temperatures and highly corrosive conditions often are encountered. Desirably, the two fluid streams flowing through the heat exchanger are substantially sealed from one another.

Cross-flow plate-type heat exchangers commonly employ a series of spaced, parallel plates carried between parallel end walls, with corner posts serving to rigidly connect the end walls. A first fluid flows through alternate spaces between the plates in a first path, and a second fluid flows in a second perpendicular path through alternate spaces adjacent the spaces of first path. Corner seals are provided to seal the aligned corners of the heat exchange plates to prevent mixing of the two fluids.

The heat exchanger plates are supported laterally in their planes by the corner posts, and the corner seals accommodate to some extent plate movement generated by thermal expansion and contraction of the plates in their planes. Substantial leakage from one fluid stream to the other may occur between the aligned plate corners and the corner posts. The rate of leakage usually increases with use, and leakage rates of thirty percent or more of the volume of one stream into the other are not uncommon. Resilient members may be employed between the aligned corners of the plates and the closely adjacent surfaces of the corner posts to support the plates and to seal the space between the corner post and the aligned plate corners. The resilient members should seal this path but should be capable of simultaneously absorbing, through movement, the substantial expansion of the plates in their planes and the high compressive forces of plate expansion without taking on a permanent compression set. Also, depending upon orientation of the heat exchanger, the resilient members may be required to bear the weight of the heat exchanger plates, which may be substantial.

DISCLOSURE OF THE INVENTION

The invention provides a heat exchanger having alternating cross-flow channels for heat exchange between two fluid streams. A stack of spaced, parallel, rectangular plates is enclosed within a frame having end walls parallel to the plates and corner posts extending between and joining corners of the end walls, the corners of the rectangular plates being aligned and spaced from adjacent corner posts. A corner support extends between the end walls and sealingly engages and supports the aligned plate corners, the corner support and the corner post having confronting, elongated surfaces extending substantially from one end wall to the other. A plurality of leaf springs elongated parallel to the corner posts are positioned between the confronting surfaces of the corner post and corner support. Each leaf spring is generally arcuate in cross-section taken transversely of its elongated direction. As thus positioned, generally arcuate surfaces of the leaf spring longitudinally engage and seal against the confronting surfaces of the corner post and corner support to provide a substantially fluid-tight transverse seal between these surfaces. The leaf spring includes a plurality of nested but individually resilient leaves enabling the leaf spring to undergo substantial compression without undergoing permanent deformation, thereby accommodating substantial growth of the plates due to thermal expansion parallel to their planes while maintaining sealing contact with the corner post and the corner support.

In a preferred embodiment, the corner post has inner surfaces presenting a generally L-shaped trough to the adjacent, aligned corners of the heat exchange plates. The corner support also is generally L-shaped in cross-section and is similarly orientated with respect to the L-shaped trough of the corner post; that is, the corner support has two outer surfaces that are at right angles to one another and that confront respective inner surfaces of the corner post. The leaf springs in this embodiment may be approximately sinuous in transverse cross-section to define a longitudinally extending, transversely generally arcuate apex and two longitudinally extending, transversely generally arcuate feet spaced from the apex. Each corner of the heat exchanger may thus utilize two leaf springs between respective parallel, confronting surfaces of the corner support and corner post, the apex of each leaf spring sealingly engaging the corner support and the transversely spaced feet of the leaf spring sealingly engaging a confronting surface of the corner post.

Although the number and thickness of leaf springs may vary widely, the leaf springs desirably include from about three to about twenty nested leaves, each leaf ranging from about 0.003 inches (about 0.08 mm) to about 0.020 inches (about 0.5 mm) in thickness.

In a modified leaf-spring embodiment, a single leaf spring is employed at each corner, the leaf spring being of generally U-shaped cross-section to define a longitudinal, central crown and two longitudinal legs. The leaf spring is oriented so that outer surfaces of the crown come into sealing contact with mutually perpendicular, plate-facing surfaces of the corner post, and the feet of the leaf spring respectively seal against mutually perpendicular surfaces of the corner support.

BRIEF DESCRIPTION OF DRAWINGS

FIG. 1 is a diagram of a typical multi-block cross-flow heat exchanger;

FIG. 2 is a perspective view of a single block multi-pass heat exchanger with stream dividers;

FIG. 3 is a perspective view of a plate block of the invention;

FIG. 4 is an exploded perspective view of a plate block of the invention;

FIG. 5 is a perspective view of a leaf spring of the invention;

FIG. 6 is a broken away cross-sectional view of FIG. 3 taken along line 6—6 thereof;

FIG. 6A is an enlarged view of circle "A" of FIG. 6;

FIG. 8 shows another modified leaf spring; and

BEST MODE OF CARRYING OUT THE INVENTION

Figure 7:
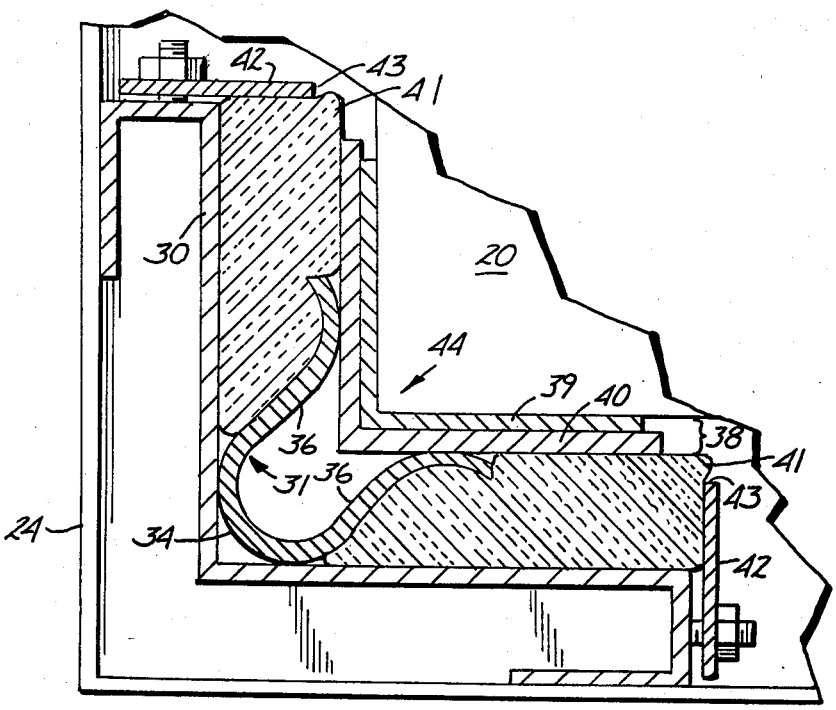
FIG. 7 is a view similar to FIG. 6 of a plate block with a modified leaf spring.

The construction and use of cross-flow plate block heat exchangers is known in the art and need not be described in detail. FIGS. 1–3 show the general configuration and operation of a cross-flow heat exchanger wherein a first fluid (80) flows along one set of paths defined by the heat exchanger plates, either absorbing or losing heat to a second fluid (90) which flows perpendicularly to the first fluid (80) through alternating adjacent plate paths.

Referring to FIG. 3, a typical plate pack for use in a heat exchanger includes a number of spaced, parallel, rectangular plates (20) and a frame enclosing the plates (20). The frame includes a pair of end walls (24) parallel to the plates (20), and corner posts (30) extending between and joining corners of the end walls (24). In the heat exchanger of the invention the plates (20) are not welded or otherwise fastened together; the plate pack is compressed resiliently by the end walls (24) and supported resiliently by corner posts (30) to effectively prevent gross movement of the plates (20) with respect to one another.

Referring to FIG. 4, the corner (44) of the plate pack is spaced from the confronting surfaces of the corner post (30), thereby providing a generally L-shaped channel through which gas from one stream might flow to contaminate the other stream of gas. A resilient corner spacer is positioned between the aligned corners of the plate pack and confronting surfaces of the corner post, the spacer including a generally right-angled corner support (38) and an elongated leaf spring (31). In the drawing, the corner support (38) comprises a sealing strip (39) of ceramic fiber mat or other suitable yieldable material held against the corner (44) of the plate pack by a comparatively rigid support strip (40); this strip distributes the force of the leaf spring (31) generally uniformly against the sealing strip (39). The sealing strip (39) may be omitted, the support strip (40) itself sealing against the corners (44) of the plates (20). In either case, the corner support (38) is resiliently urged against the corner of the plate pack by the elongated leaf springs (31) which are positioned between the corner support (38) and the corner post (30). As depicted, the leaf springs (31) press against the support strip (40) which in turn exerts surface-to-surface pressure upon the sealing strip (39).

The leaf springs (31) complete the seal at the corner by resiliently and sealingly engaging the corner support (38) and the corner post (30) to prevent transverse fluid flow therebetween. Each leaf spring (31) is substantially impermeable to fluid flow, is elongated so as to extend substantially from one end wall to the other, and has a generally arcuate transverse cross-section throughout its length.

FIGS. 5 and 6 show a preferred spring configuration which is approximately sinuous. The spring (31) has a central, longitudinal apex (32) and two longitudinal feet (33) spaced from the apex (32). Each spring (31) includes a plurality of nested but individually resilient leaves (35), shown in better detail in FIG. 6A. The individual leaves (35) preferably are from about 0.003 inches (about 0.08 mm) to about 0.020 inches (about 0.5 mm) in thickness. The leaves may be made from a variety of materials including carbon steel, stainless steel, and other materials suitable for use in heat exchangers.

Each individual leaf (35), because of its thinness, can be compressed (flattened) severely without permanently deforming, and has a relatively small spring constant. When a number of leaves (35) are nested together and the leaves (35) are compressed into full surface-to-surface contact with one-another, the spring constants of individual leaves (35) are approximately additive. Each leaf's ability to be compressed without permanently deforming, however, is unaffected. Thus, the composite leaf spring (31) has a large spring constant but is able to withstand substantial compression without experiencing permanent deformation. This property allows for firm, effective sealing pressure against the corner support (38) and corner post (30) at relatively low temperatures while, at high temperatures, allowing for substantial spring compression without permanant deformation to accommodate gross thermal expansion of the plates (20) parallel to their planes.

The spring constant of the composite leaf spring (31) is a function of the leaf material, the thickness of each individual leaf (35), the number of leaves (35) employed and the geometry of the leaves (35) in relation to the corner post (30) and corner support (38). Preferably the number of leaves (35) is from about three to about twenty. The exact size and construction of the leaf spring (31), of course, will be dictated by the size, type, and contemplated use of the heat exchanger.

The leaf springs (31) shown in FIG. 6 are generally sinuous in cross-section, having a central longitudinal apex (32) and two longitudinal feet (33) spaced laterally from and on opposite sides of the apex (32). The feet (33) and apex (32) define lines of sealing contact with the corner post (30) and corner support (38). In practice, these lines are actually longitudinal regions. From a purely geometric standpoint, the contact between an elongated, transversely arcuate surface and another generally planar surface is a line contact. The transversely generally arcuate apexes and feet of the leaf springs used herein need not be perfectly arcuate, and may in fact be formed with transversely merging generally flat surfaces approximating a smooth curve in the manner that a many sided polygon approximates a circle. Thus, the contacts between the substantially arcuate surfaces of the leaf spring and the longitudinal surfaces upon which they bear may in fact be substantially surface-to-surface contacts.

At least one foot (33) of each spring (31) must have some transverse freedom of movement in order to permit the spring (31) to yield elastically under compression. Preferably, both feet (33) have transverse freedom of movement through sliding contact with the corner post or corner support, and are spaced from the outwardly turned edge (45) of the leaf spring (31) to prevent the edge (45) from "snagging" or frictionally inhibiting transverse movement of the feet (33).

As depicted in FIG. 6, the apex (32) engages the corner seal (38) and the feet (33) engage the corner post (30). Although less preferred, the spring (31) could be reversed so that the apex (33) engages the corner post (30). As shown in FIG. 8, the confronting surfaces of the corner post (30) and the corner support (38) may include a layer of suitable gasket material (46), such as ceramic fiber mat, to enhance sealing of the leaf spring (31) against these surfaces.

Figure 9:
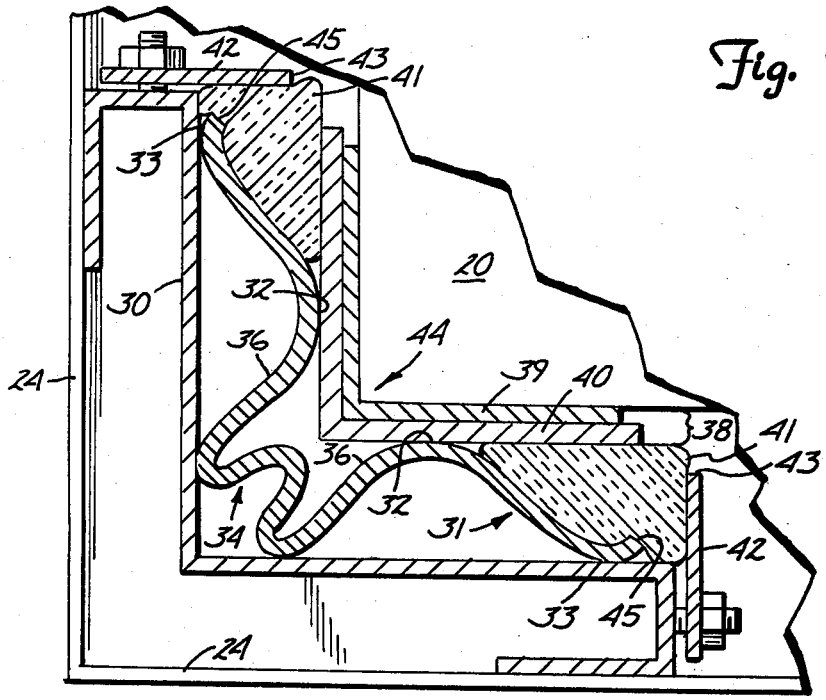
FIG. 9 shows yet another modified leaf spring.

Although the spring configuration of FIG. 6 has given particularly good results, a variety of other configurations are also useful. By way of example, FIGS. 7–9 depict three configurations. The arcuate cross-section of the spring in FIG. 7 is generally U-shaped, having a central crown (34) abutting both surfaces of the corner post (30), and two longitudinal legs (36) spaced from the crown (34) and in operative contact with the adjacent corners (44) of the plates (20) by way of the corner support (38).

FIG. 8 shows a modification of the spring of FIG. 7 wherein each leg (36) of the spring (31) is generally sinuous in cross-section and includes a longitudinal foot (33) for contact with the corner post (30). The spring of FIG. 8 may be further modified to space the crown (34) from the corner post (30). In such an embodiment the spring (31) would only contact the corner post (30) at the feet (33). Other configurations of springs with more or fewer lines of contact could also be utilized. To enhance sealing, however, the three-line contact of the springs (31) in FIG. 6 is most preferred.

Relief must be provided to permit transverse expansion of the spring (31) under a compressive load. The U-shaped springs of FIGS. 7–8 will expand only away from the corner; FIG. 9 shows a modification which allows for transverse expansion of the spring (31) both toward and away from the corner.

Thermal insulation (41) may be provided in the space between the plates (20) and the leaf spring (31) to protect the leaf spring (31) from extreme temperatures and the corrosive effects of gases which may flow through the heat exchanger. A retaining plate (42) may also be provided to retain both the insulation (41) and the leaf spring (31) in proper position. The edge (43) of the retaining plate (42) which is nearest the plate pack, however, must be spaced from the pack to allow for thermal expansion of the plates (20).

The components of the heat exchanger of the invention may be manufactured by well known techniques. In particular, the leaf springs (31) may be manufactured by stamping individual leaves (35) to the desired configuration. Although the springs (31) shown in FIGS. 7–9 are useful modifications, for ease of manufacture and assembly the springs (31) of FIG. 6 are most preferred. In operation, the leaves (35) of an individual spring (31) need not be mechanically fastened to one another. Their configuration and the heat exchanger's structure will assure their proper orientation, and their tight nesting, enhanced by compressive forces, precludes significant leakage of fluid between leaves (35).

For ease of manufacturing and assembly, however, it may be desirable to fasten the leaves (35) together. It will be appreciated that as the leaf spring (31) is compressed, the curve of the spring (31) causes the various leaves (35) to slide transversely slightly with respect to one another, except along a central longitudinal line. Thus, any fastening of the leaves (35) should be done along this longitudinal center line. For example, in the spring (31) of FIG. 6, fastening should be done only along the longitudinal apex (32). On the spring (31) of FIG. 8, fastening should be done only at the center of the crown (34). Fastening can be accomplished by any of a number of suitable means, including, by way of example, lines or spots of adhesive or spot welds.

It will now be appreciated that a heat exchanger equipped with the leaf springs (31) of the invention accommodates significant plate growth due to thermal expansion parallel to the planes of the plates without permanent deformation of the springs while maintaining effective seals between the plate corners and the corner posts, even under extreme temperatures.

While a preferred embodiment of the present invention has been described, it should be understood that various changes, adaptations and modifications may be made therein without departing from the spirit of the invention and the scope of the appended claims.

What is claimed is:

1. A cross-flow heat exchanger for heat exchange between two fluids, comprising a stack of spaced, parallel rectangular plates; a frame enclosing the plates and having generally rectangular end walls parallel to the plates and corner posts extending between corners of the end walls; corner supports extending between the end walls and sealingly engaging respective aligned plate corners; and a plurality of leaf springs, each having a plurality of nested but individually resilient leaves and being elongated parallel to the corner posts and having a generally arcuate transverse cross-section providing spaced surfaces bearing respectively against a corner post and a corner support to resiliently seal the corner post to the corner support to substantially prevent fluid flow therebetween and to resiliently accommodate growth of the plates due to thermal expansion parallel to their planes.

2. The heat exchanger of claim 1 wherein the transverse arc of the leaf spring is approximately sinuous.

3. The heat exchanger of claim 1 wherein the transverse arc of the leaf spring defines a longitudinal apex and two longitudinal feet spaced from the apex.

4. The heat exchanger of claim 3 wherein the corner support includes a right-angle support strip parallel to the corner post and a sealing strip of a yieldable material between the support strip and adjacent corners of the plates.

5. The heat exchanger of claim 3 wherein the apex of each leaf spring sealingly abuts a corner support, and the longitudinal feet sealingly abut a corner post.

6. The heat exchanger of claim 3 wherein the leaf spring is free to expand transversely as it is compressed by thermal expansion of the plates.

7. The heat exchanger of claim 1 wherein at least one corner post includes two leaf springs oriented approximately perpendicular to one another to accommodate thermal plate growth in mutually perpendicular directions parallel to the planes of the plates.

8. The heat exchanger of claim 1 wherein the leaf spring includes two longitudinal legs and a longitudinal crown defining a generally U-shaped cross-section, the crown sealingly abutting a corner post and the legs respectively in sealingly abutting the corner support.

9. The heat exchanger of claim 8 wherein each of the longitudinal legs of the leaf spring is sinuous in transverse cross-section, and includes a longitudinal foot for contact with the corner post.

10. The heat exchanger of claim 1 wherein the leaf spring includes from about three to about twenty leaves.

11. The heat exchanger of claim 1 wherein the respective leaves are from about 0.003 inches (about 0.08 mm) to about 0.020 inches (about 0.5 mm) in thickness.

12. A heat exchanger providing alternating cross-flow channels for heat exchange between two fluid streams and comprising a stack of consecutive, spaced, parallel rectangular plates; a frame enclosing the plates and having generally rectangular end walls parallel to the plates, and corner posts extending between and joining corners of the end walls; and at least one resilient corner spacer extending between and spacing corners of the plates from adjacent corner posts to accommodate growth of the plates due to thermal expansion parallel to their planes, said spacer including a corner support extending between the end walls and sealingly engaging the aligned plate corners, and a leaf spring having from three to twenty nested leaves, the leaf spring being substantially impenetrable to fluid flow, elongated parallel to the corner post and of generally arcuate cross-section defining a longitudinal apex and two longitudinal feet spaced from the apex, the apex and longitudinal feet sealingly abutting one of the corner support and the corner post, resiliently sealing the corner post to the corner support to substantially prevent fluid flow therebetween.

13. A heat exchanger providing alternating cross-flow channels for heat exchange between two fluid streams and comprising a stack of consecutive, spaced, parallel rectangular plates; a frame enclosing the plates and having generally rectangular end walls parallel to the plates and corner posts extending between and joining corners of the end walls; and at least one resilient corner spacer extending between and spacing corners of the plates from adjacent corner posts to accommodate growth of the plates due to thermal expansion parallel to their planes, said spacer including a corner support extending between the end walls and sealingly engaging the aligned plate corners, and a leaf spring having from three to twenty nested leaves, the leaf spring being substantially impenetrable to fluid flow, elongated parallel to the corner post and having a longitudinal crown and two longitudinal legs defining a generally U-shaped cross-section, the crown of the leaf spring sealingly abutting a corner post and the longitudinal legs sealingly abutting the corner support to substantially prevent fluid flow between the corner post and the corner support.

* * * * *